United States Patent [19]

McCloud

[11] 4,382,598

[45] May 10, 1983

[54] ROD BEARING FOR TABLE SOCCER OR FUSSBALL GAME STRUCTURE

[76] Inventor: Calvin E. McCloud, 5204 Airport Fwy., Ft. Worth, Tex. 76117

[21] Appl. No.: 364,802

[22] Filed: Apr. 2, 1982

[51] Int. Cl.[3] ..... A63F 7/06; A63F 7/36

[52] U.S. Cl. ..... 273/85 D; 308/22; 308/238; 384/285; 384/439

[58] Field of Search ..... 273/85 C, 85 D; 308/22, 308/27, 15, 238

[56] References Cited

U.S. PATENT DOCUMENTS

| | | | |
|---|---|---|---|
| 1,105,097 | 7/1914 | Orban | 308/15 |
| 1,416,246 | 5/1922 | Turck | 308/238 |
| 1,783,446 | 12/1930 | Overbury | 308/22 |
| 3,382,015 | 5/1968 | Steidl | 308/22 |
| 3,383,142 | 5/1968 | Scott | 308/27 X |
| 3,724,851 | 4/1973 | Cecchetti | 273/85 D |
| 4,084,863 | 4/1978 | Capelli | 308/238 |
| 4,168,636 | 9/1979 | Kocher | 308/15 X |

FOREIGN PATENT DOCUMENTS

| | | | |
|---|---|---|---|
| 329585 | 6/1918 | Fed. Rep. of Germany | 308/22 |
| 1012694 | 4/1952 | France | 273/85 D |
| 1032209 | 3/1953 | France | 273/85 D |
| 1036018 | 4/1953 | France | 273/85 D |
| 2230164 | 12/1974 | France | 273/85 D |
| 724921 | 11/1966 | Italy | 273/85 D |

*Primary Examiner*—Paul E. Shapiro

*Attorney, Agent, or Firm*—Stanley R. Moore; Thomas L. Crisman

[57] ABSTRACT

An improved bearing structure for a rod which permits both rotational and axial movement of the rod in conjunction with longitudinal bending thereof. Two semi-cylindrical pieces are assembleable along an axial line of separation to enclose a ring of low friction material and form a first cylindrical bearing half while a second cylindrical bearing half is integrally formed for matingly receiving the first half. The two halves of the bearing each include an outer, radially extending flange and are each passed through opposite sides of an aperture in a wall and are assembled into a complete bearing by threadably engaging one another within the hole. The rod to be journaled is inserted through an axial opening formed through the bearing. The axial opening of the second bearing half is constructed with a larger diameter than the anti-friction ring for permitting a select degree of longitudinal bending within the elastic limits of the materials involved.

9 Claims, 6 Drawing Figures

ROD BEARING FOR TABLE SOCCER OR FUSSBALL GAME STRUCTURE

BACKGROUND OF THE INVENTION

1. Field of the Invention

The invention relates to an improved rod bearing, and, more particularly, to an improved bearing for journaling a playing figure actuation rod in a fussball game table.

2. History of the Prior Art

This invention is directed to a bearing member for a fussball (also known as table soccer) game table generally of the type shown in U.S. Pat. No. 3,926,432. Typically, fussball game tables include a rectangular, box-like playing area supported on four legs. A plurality of axially slideable and rotatable rods are mounted on bearings and extend transversely of the playing area. The actuation rods each mount a plurality of playing figures which are arranged above the playing surface of the table in preselected formations. A light ball is placed on the playing surface and propelled by sharply rotating the actuating rods with their respective bearings, so that the foot of the playing figure strikes the ball and propels it along the playing surface toward one of the two goals located at opposite end walls of the table.

The rod bearings on prior art fussball tables are generally the most difficult portions of the table to service and maintain. In operation in a vending machine environment, the playing figure actuation rods gather dust from the environment and dirt and other soil from handling during operation. Because the actuation rods are continually being rapidly moved in an axial manner back and forth within the rod bearings dirt, debris and other matter deposited on the rods is scraped therefrom by the edges of the bearings. Consequently, the rod bearings must be removed and the bearing surfaces cleaned frequently to ensure smooth, rapid operation of the playing figure actuation rods.

Certain techniques for minimizing the maintenance required for fussball table rod bearings have been utilized in the past. For example, rod bearings have been constructed to include a circumferentially extending channel around the outside of the bearing so as to define a knife edge trough contiguous to the rod receiving aperture. This knife edge is intended to shave foreign material from the rod and collects it in the trough as the rod is slid back and forth within the bearing. This structure is intended to simplify maintenance by enabling one to merely clean the troughs periodically and avoid the time consuming removal of the bearings from the machine in order to effectuate cleaning. However, such bearing structures leave much to be desired in that a great deal of foreign matter is still collected on the interior bearing surface and may result in binding of the rods unless the bearings are periodically removed and the interior bearing surface thoroughly cleaned.

Prior art separable rod bearing structures overcome some of the maintenance difficulties such as ease of removal for cleaning. However, certain major problems are still present. For example, a rod moving in a prior art bearing must be lubricated frequently in order to maintain as low function as possible. In addition, the lubricant, typically a silicone spray material, builds up deposits on the rod which must be removed. The lubricant also attracts and holds dust and dirt to the rod further complicating rod bearing maintenance. The structure of the separable rod bearing of the present invention includes an anti-friction ring which virtually eliminates a need for lubricant greatly simplifying table soccer maintenance procedures.

Fussball rod bearings also receive a type of loading which is often damaging to the actuation rods. Game players generally bear down on the actuation rods with large portions of their weight before and during movement of the playing figure. This weighting causes the rod to bend, or flex, above the bearing surface. Many prior art bearings incorporate a circumferential ridge, or narrow land, within the bearing which effectively functions as a fulcrum or point of bending during weighting. The result of unlimited fulcrum bending is plastic deformation of the actuation rod, which commonly occurs in the vicinity of the nearest aperture formed in the rod. The playing figures are secured to the actuation rods through such apertures. These apertures comprise the weakest sections of the actuation rods subjected to bending loads and often exhibit shear rupture during heavy loading. The rod bearing of the present invention overcomes this problem by providing a stop element outwardly of the anti-friction bearing ring which prevents flexure of the rod across the bearing ring beyond the elastic limit of the nearest aperture.

SUMMARY OF THE INVENTION

The invention relates to an improved bearing structure for an actuation rod of a table soccer game. More particularly the table soccer game structure is of the type having a playing field portion surrounded by raised opposite side walls and raised end walls wherein a plurality of actuating rods extend through apertures in opposite side walls. The rods are spaced traversely of and above the playing field and support game figures thereon. The game figures are adapted to contact a ball disposed on the field. The actuating rods are rotatively and axially movable relative to the side walls. The improvement inludes a rod bearing mounted in each aperture in the side walls. The bearing comprises a first bearing half having an outer sleeve portion snugly received into one of the apertures in the table wall. The sleeve portion has an inner threaded cylindrical wall for receiving a second bearing half, and a radially extending flange for engaging the outer side wall adjacent the aperture. The flange includes a circular clearance aperture for receiving a playing rod coaxially-through the bearing half. A second bearing half includes an outer cylindrical threaded portion for engaging the threaded inner wall of the first bearing half, an outer sleeve portion received into one of the apertures in the table wall and separated from the threaded portion by a stepped region, and a radially extending flange for engaging the inner side wall adjacent the aperture. The flange includes a clearance aperture for receiving a playing rod coaxially through the bearing half. The second bearing half is separable along opposed axial parting lines into two identical halves to expose an enlarged cylindrical cavity adjacent the inner wall of the flange and coaxial with the clearance aperture. A bearing ring is positioned in the cylindrical cavity of the second bearing half and has an inner diameter sized to closely receive a playing rod. The ring is formed of an anti-friction material to smoothly journal the rod for axial and rotational movement with the only contact between the rod and the assembled rod bearing, when the axis of the rod is straight, being at the inner surface of the bearing ring.

In another aspect, the invention includes a rod bearing for a fussball game table playing figure actuation rod comprising a pair of coaxial bearing valves. Each bearing half includes a cylindrical outer sleeve portion for engaging the inner wall of a rod opening through a game table wall, and radial flanges for engaging the table walls adjacent the opening. The flanges each have clearance holes for receiving a rod extending coaxially through the bearing. The halves each have mating threaded portions for assembly of the two halves from opposite sides of a rod opening in a game table wall. One of the halves is separable into identical hemicylindrical portions along opposed, axial parting lines to expose an inner chamber within which is positional an anti-friction bearing ring, the bearing ring includes an inner diameter sized to closely receive and journal a rod for axial and rotational movement within the bearing. The hemicylindrical portions of the bearing half may also include interfitting axial alignment means along the parting lines thereof to axially align the thread on each of the two portions for engagement with the other bearing half.

BRIEF DESCRIPTION OF THE DRAWINGS

For a more complete understanding of the invention, and for further objects and advantages thereof, references may be now had to the following description taken in conjunction with the accompanying drawings in which.

DETAILED DESCRIPTION

Figure 1:
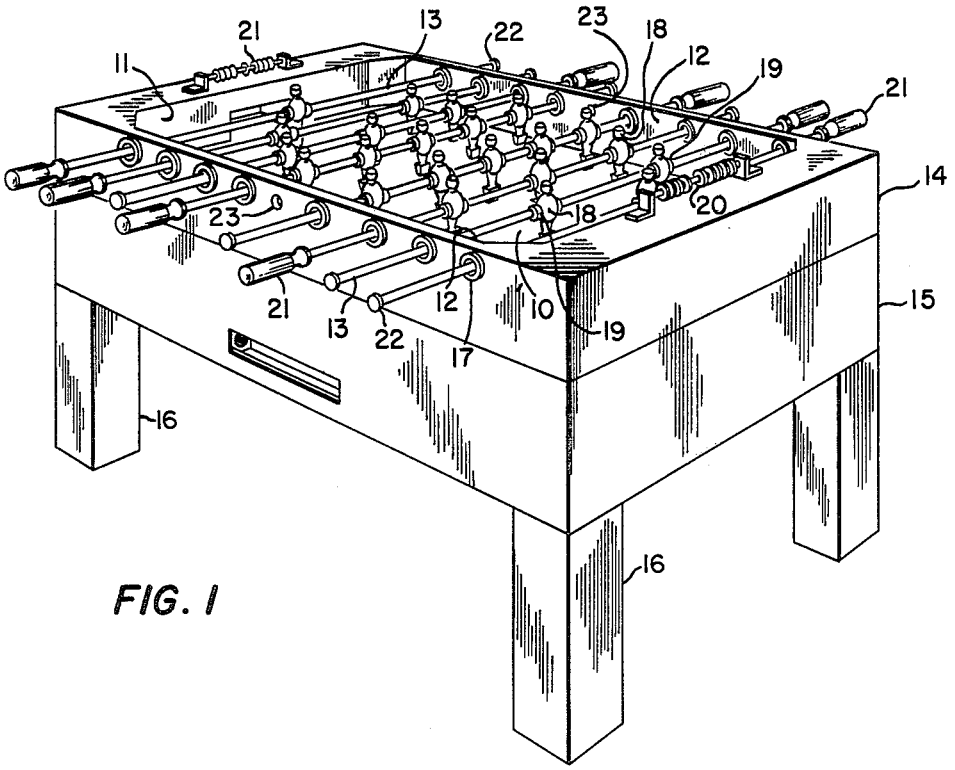
FIG. 1 is a perspective view of a fussball game table incorporating the improved bearing of the present invention.

Referring first to FIG. 1, the game table, within which the bearing of the present invention may be used, includes a playing surface 10 and vertically extending end and side walls 11 and 12, respectively. A plurality of transversely disposed playing figure actuation rods 13 are rotatably mounted and axially slideable in opposite side walls 12. The playing surface 10 and the vertically extending end and side walls 11 and 12 comprise a top housing unit 14. The top unit 14 is hinged along the back edge to a lower housing unit 15 which is supported upon four vertically extending rectangular legs 16.

The actuating rods 13 are rotatable and slideably supported in a plurality of pairs of bearings 17 located in each side wall through which the actuating rods 13 pass. The bearings 17 are received into clearance apertures passing through the opposed longitudinal side walls 12 in each position in which an actuating rod is to pass. Each actuating rod 13 rigidly mounts one or more game figures 18. Soft, shock absorbing rubber bushings 19 are mounted to the actuating rods 13 and located outside the outermost game figures 18 on each rod. During vigorous playing the actuating rods 13 are quickly shifted laterally and rotationally in the bearings 17 to move the figures carried thereby relative to the playing surface 10 and manipulate a playing ball (not shown) upon the playing surface 10. The rubber bushings 19 function as bumpers to prevent the game figures 18 from striking too hard against the inner sides of the walls 12. Each of the actuating rods 13 is affixed to a handle 21 at the playing end and terminated by a cap 22 at the opposite end. The upper housing 14 includes ball drop openings 23 passing through opposite side walls near the center of the playing surface 10 and score keepers 20 located on the tops of opposite ends.

Figure 2:
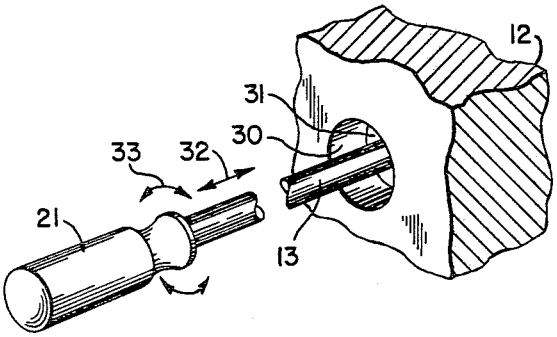
FIG. 2 PRIOR ART
FIG. 2 is a fragmentary perspective view of the outside of a prior art rod bearing structure.

Referring now to FIG. 2, there is shown a fragmentary perspective view of a prior art bearing and rod structure to aid in illustrating certain of the advantages of the bearing structure of the present invention. As mentioned above, the playing figure actuation rods 13 pass through the side walls of the table 12 by means of enlarged clearance holes 30. The prior art bearing members 31 include a flange which is mounted against the inside surface of the side wall 12. The handle 21 enables manipulation of the playing figure actuation rod 13 in both the axially slideable direction as well as the rotational direction as indicated by arrows 32 and 33, respectively.

Figure 3:
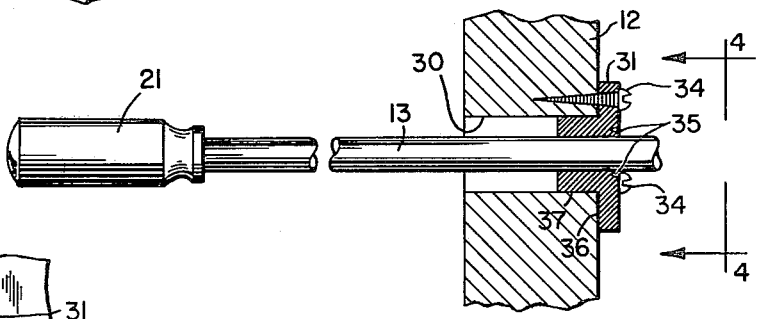
FIG. 3 PRIOR ART
FIG. 3 is a cross-sectional view of the prior art bearing structure shown in FIG. 2.

Referring now to FIG. 3, there can be seen a cross-sectional view of a prior art bearing as illustrated in FIG. 2. As shown, the prior art bearing 31 is snugly received into the clearance hold 30 in the side wall 12. The prior art bearing 31 includes a radially, outwardly extending flange portion 36 which fits flush against the inside walls of the sidewall 12 and a cylindrical portion 37 which is received into the cylindrical opening 30. Bearing 31 is held in place within and upon the side wall by means of a plurality of screws 34 which extend through the sides of the outer flange 36 into the walls 12.

Figure 4:
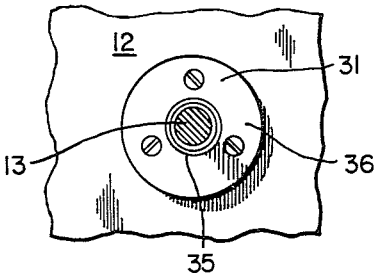
FIG. 4 PRIOR ART
FIG. 4 is an end view of the prior art bearing structure as viewed from the position of the lines 4—4 of the FIG. 3.

In certain prior art rod bearing structures, means have been included which seek to facilitate the maintenance for the rod such as the circumferentially extending groove 35. The groove 35 defines an edge surface contiguous to the surface of the rods so that as the rod is drawn through the bearing the edge will scrape foreign material from the rod and collect it in the groove 35. As shown in FIG. 4., the groove 35 extends circumferentially around the rod 13 in the upper face of the flange member 36. Theoretically this bearing may be cleaned by merely running an instrument around the groove 35 so as to remove the foreign matter collected therein after it has been scraped from the surface of the rods 13 by means of the inner edges of the groove 35. Although the cleaning groove 35 does some good, in practice, it is still necessary to remove the prior art bearing structure 31 from its position periodically in order to remove the collected foreign matter within the inner rod engaging surface in the bearing. This requires removal of the three screws 34 for each bearing, disassembly of the rod from the bearing and cleaning of the inside bearing surface. In addition, the rod 13 must be periodically lubricated with silicone to insure smooth, frictionless operation of the rod within the bearing. Lubricant deposits, such as silicone, further increase the frequency with which prior art bearings, including those of the disassembleable type, must be maintained. Such maintenance procedures are very time consuming and expensive when considered from a vending machine maintenance standpoint. The bearing of the present invention is designed to function as a more efficient, lubricationless bearing and to facilitate maintenance of bearings on a fussball game table.

Figure 5:
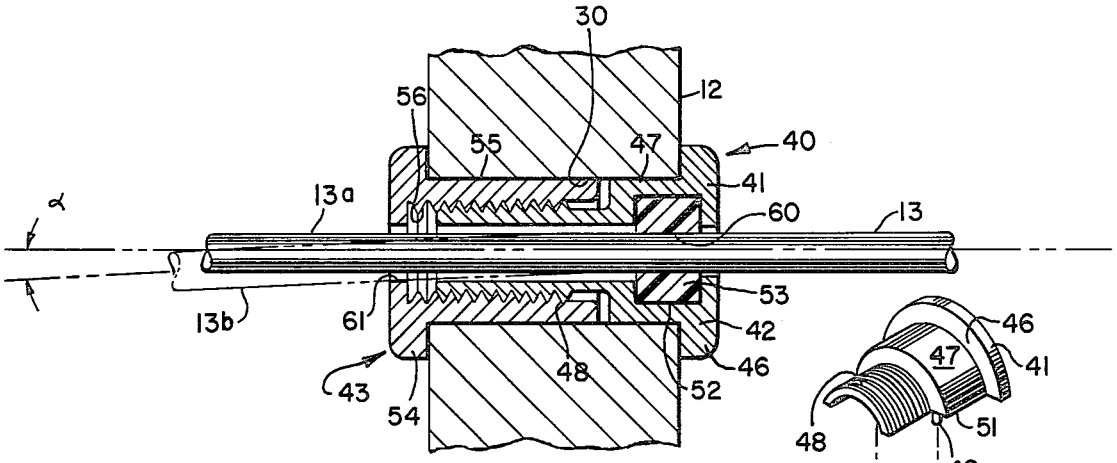
FIG. 5 is a cross-sectional view of the rod bearing structure of the present invention.

Referring first to FIG. 5, there is shown a cross-sectional view of the improved bearing of the invention in an assembled configuration 40. The bearing 40 comprises three separate individual pieces. A male half of the bearing is comprised of two identical, hemicylindrical pieces 41 and 42 fitted together. The female half of the bearing is comprised of an integrally formed single cylindrical piece 43.

Figure 6:
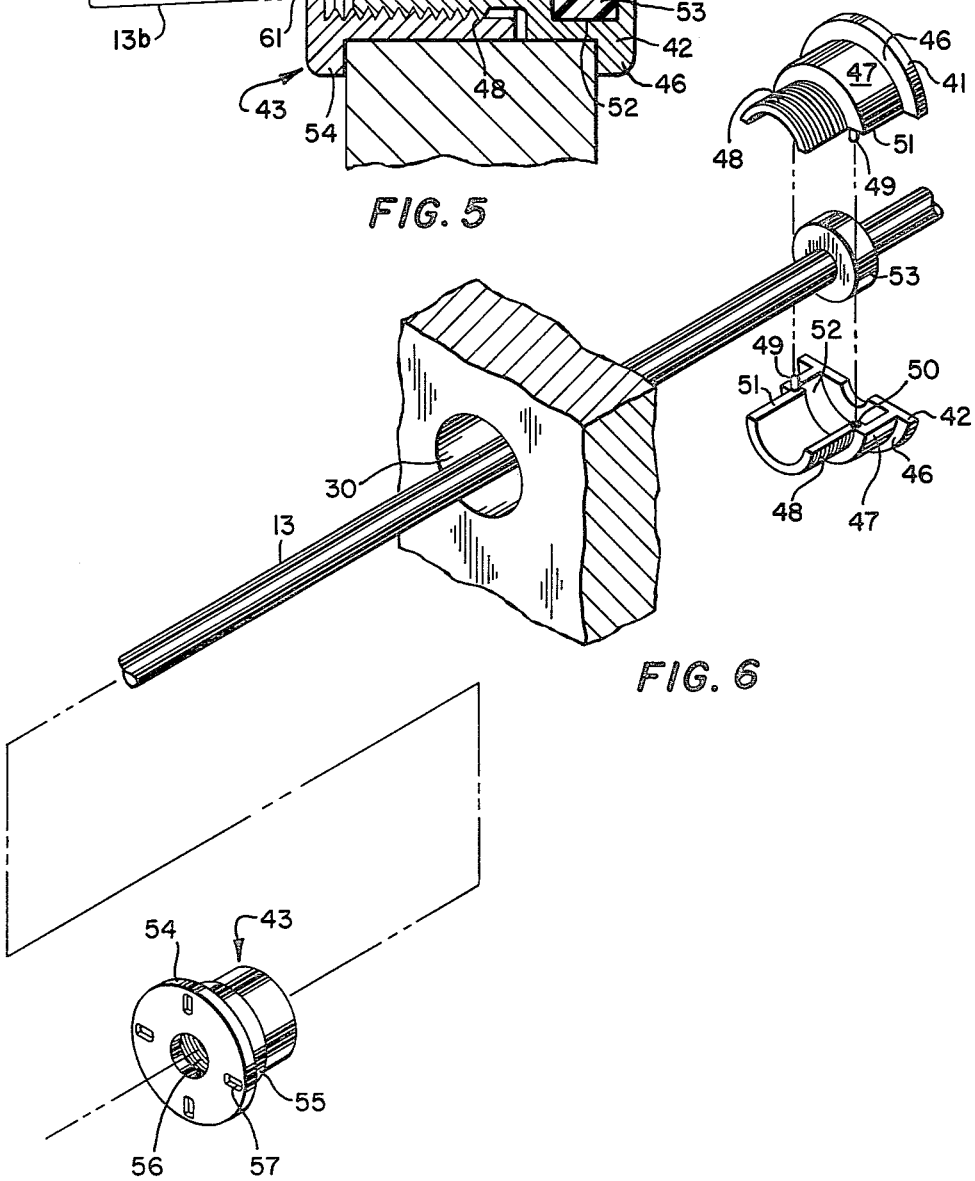
FIG. 6 is a fragmentary exploded view of the bearing of the present invention and illustrates its appearance when disassembled into its four component portions.

Referring now to FIG. 6, each of the two pieces 41 and 42 comprising the male half of the bearing includes a cylindrical outer flange portion 46 which overlies the outer edge of the inner wall 12 and a cylindrical portion 47 of approximately the same diameter as the inner diameter of the clearance hole 30. Extending forwardly from the cylindrical section 47 is a threaded cylindrical portion 48 which forms a male threaded portion of one-half of the bearing. The two portions of the male half of the bearing are separable along an axial centerline which includes flat mating surfaces 51 defining the line of separation between the two portions. Formed on one side of the flat portion 51 is an upstanding mounting and securing tab 49. Opposite the securing tab is formed a securing groove 50 in the surface of the separation surface 51. Each of the two halves include a cylindrical recess 52 for receiving bearing ring 53 preferably formed of an anti-friction material such as that sold under the tradename of TEFLON. The inner diameter of the ring 53 is formed in a rigid configuration to closely receive a bearing rod 13 and provide an essentially frictionless bearing surface for the rod. The ring 53 generally restrains the rod 13 from transverse movements but permits smooth axial and radial movements. The two halves 41 and 42 are identical to one another so that when the halves are positioned with the respective flat portions 51 in a facing relationship, a mounting tab 49 is received into a mounting groove 50 in each of the two halves in order to align the two halves. The two recesses 52 then form a cylindrical chamber containing the bearing ring 53. In particular, the mating tabs and grooves serve to align the molded threads 48 such that the ridge and valley pattern of each of two halves will mate with one another to form a continuous spiral screw thread.

The female half of the bearing is comprised of a single portion 43, including a radially, outwardly extending flange portion 54 which overlies the outer surface of the wall, and a cylindrical inner portion 55 which is snugly received into the clearance hole 30. The inside wall of the portion 43 includes screw threads 56 which forms a continuous spiral screw thread for reception of the male screw threads 48 on the other half of the bearing. To assemble the bearing, the two male portions of the bearing 41 and 42 are brought together to enclose the bearing ring 53 and form the male half for securement to the female portion 43. The two halves of the bearing are then inserted into opposite ends of the receiving holes 30 where they are threadably engaged with one another and the flanges of each half are pulled snugly against the inner and outer wall surfaces. The outer faces of both halves include tool engaging recesses 57 to install and remove the bearing. The asembled bearing is shown in FIG. 5.

From FIG. 6 it may also be seen that the female half of the bearing 43 includes a rigid circular opening 58 having a diameter greater than that of the bearing ring 53 by a preselected amount. The function of this enlarged opening 58 may be best understood by reference to FIG. 5. The playing figure actuation rod 13 is shown in phantom in FIG. 5 in two different configurations in the left most portion (the actuation handle end) of the rod. First, the rod is normally in a position as shown in phantom in portion 13*a*, that is the rod extends straight through the bearing on the same axial line as that of the bearing. Sometimes during particularly vigorous playing periods, the actuating handles may be moved about by a player (weighted) such that the rods may be deflected downwardly to as much as or greater than the position shown in phantom as position 13*b*. Unrestrained deflection of the actuation rods to this extent may result in a permanent deformation of the metal such that the rod is bent. Once bent, actuation rods are very difficult to straighten and of considerable expense to replace. The angle between the axial center lines of the rod in position 13*a* deflected into position 13*b* is the maximum deflection of the rod which the rod is capable of undergoing without permanent deformation. Since deformation is primarily manifested in the area of the weakest section of the rod near the bearing, it is this area which determines maximum available deflection. The diameter of the opening 56 in the bearing half 43 is selected to engage the surface of the rod 13 when it has been deflected to the maximum permissable angular deflection of the rod without deformation. That is when the rod 13 reaches the position 13*b* within the bearing 40, the rod, which has been flexing about any point 60, is brought to bear against a second flexure point 61 spaced from point 60 and consequently resists permanent deformation of the rod by providing additional support.

As can be seen, the improved bearing structure of the present invention is very simple to totally disassemble. By merely screwing the male and female halves apart from one another each can be withdrawn from within the clearance hole 30. It may be further disassembled by breaking the two halves 41 and 42 comprising the male portion into two parts to expose the bearing ring therein to permit easy and rapid cleaning. Further, the improved bearing of the present invention is very simple to manufacture in that only two distinct parts are required for the three part bearing. Since each of the two parts 41 and 42 comprising the male halves of the bearing, are identical with one another so that manufacture, stocking of parts, and the readiness of interfitting is greatly facilitated. The parts are preferably formed by injection molding from plastic. The bearing ring is also injection molded from an anti-friction material such as TEFLON. The additional feature of the selectively enlarged opening in the female bearing half formed to lie in engagement with the rod only after it has been flexed to its point of plastic deformation, is an additional feature of the bearing of the present invention. This feature reduces maintenance and prolongs the life of the most highly stressed portions of a fussball game table.

It is thus believed that the operation and construction of the present invention will be apparent from the foregoing description. While the apparatus as shown and described has been characterized as being preferred it will be obvious that various changes and modifications may be made therein without departing from the spirit and scope of the invention as defined in the following claims.

I claim:

1. An improved table soccer or fussball game structure of the type having a playing field portion surrounded by raised opposite side walls and raised end walls wherein a plurality of actuating rods extend through apertures in said opposite side walls and are spaced transversely of and above said playing field portion, said rods supporting game figures thereon which depend adjacent said playing field portion to contact a ball disposed thereon, said actuating rods being rotatively and axially movable relative to said side walls, and wherein the improvement includes a rod bearing mounted in each aperture in said side walls, said bearing comprising:

a first bearing half having an outer sleeve portion snugly received into one of the apertures in the table wall, said sleeve portion having an inner threaded cylindrical wall for receiving a second bearing half, and a radially extending flange for engaging the outer side wall adjacent the aperture, said flange including a circular clearance aperture for receiving a playing rod coaxially through the bearing half;

a second bearing half having an outer cylindrical threaded portion for engaging the threaded inner wall of the first bearing half, an outer sleeve portion received into one of the apertures in the table wall and separated from the threaded portion by a stepped region, and a radially extending flange for engaging the inner side wall adjacent the aperture, said flange including a clearance aperture for receiving a playing rod coaxially through said bearing half, said second bearing half being separable along opposed axial parting lines into two identical halves to expose an enlarged cylindrical cavity adjacent the inner wall of said flange and coaxial with the clearance aperture; and a bearing ring positioned in said cylindrical cavity of the second bearing half and having an inner diameter sized to closely receive a playing rod, said ring being formed of an anti-friction material to smoothly journal the rod for axial and rotational movement with the only contact between the rod and the assembled rod bearing, when the axis of the rod is straight, being at the inner surface of the bearing ring.

2. The improved game structure as set forth in claim 1 wherein the identical halves of said second bearing half each include a tab extending transversely of the parting line on one side and an aligned tab receiving recess extending transversely of the parting line on the other side to engage mating parts and hold the threaded portions of the identical halves of the second bearing half in alignment during engagement with the first bearing half.

3. The game structure as set forth in claim 1 wherein the circular clearance aperture in the flange of the first bearing half is sized to abuttingly engage the rod upon transverse flexure of the outer end of the rod to its elastic limit and support the rod against plastic deformation.

4. The game structure as set forth in claim 1 wherein the outer sleeve portions of both bearing halves are cylindrical for reception into circular apertures in the game table walls.

5. The game structure as set forth in claim 1 wherein the outer faces of the radially extending flanges of both bearing halves include tool engagement recesses for tightening and loosening the two threadedly engaged halves.

6. A rod bearing for a fussball game table playing figure actuation rod, comprising:

a pair of coaxial bearing halves each including a cylindrical outer sleeve portion for engaging the inner wall of a rod opening through a game table wall, and radial flanges for engaging the table walls adjacent the opening, said flanges each having clearance holes for receiving a rod extending coaxially through the bearing, said halves each having mating threaded portions for assembly of the two halves from opposite sides of a rod opening in a game table wall, one of said halves being separable into identical hemicylindrical portions along opposed, axial parting lines to expose an inner chamber within which is positional an anti-friction bearing ring having an inner diameter sized to closely receive and journal a rod for axial and rotational movement within the bearing.

7. A rod bearing for a fussball game table playing figure actuation rod as set forth in claim 6 wherein the hemicylindrical portions of one bearing half include interfitting axial alignment means along the parting lines thereof to axially align the thread on each of the two portions for engagement with the other bearing half.

8. A rod bearing for a fussball game table playing figure actuation rod as set forth in claim 6 wherein the integral bearing half is positioned against the outside wall of the game table.

9. A rod bearing for a fussball game table playing figure actuation rod as set forth in claim 6 wherein the bearing ring is positioned to support the actuation rod against transverse movement and wherein the clearance hole of the integral bearing half is sized to engage and support the rod upon transverse bending of the outer end of the rod to its elastic limit and prevent plastic deformation of the rod.

* * * * *